United States Patent [19]

Geringer et al.

[11] Patent Number: 4,671,221

[45] Date of Patent: Jun. 9, 1987

[54] VALVE CONTROL ARRANGEMENT

[75] Inventors: Bernhard Geringer, Pischelsdorf, Austria; Ernst Linder, Mühlacker, Fed. Rep. of Germany; Helmut Rembold, Stuttgart, Fed. Rep. of Germany; Manfred Ruoff, Möglingen, Fed. Rep. of Germany

[73] Assignee: Robert Bosch GmbH, Stuttgart, Fed. Rep. of Germany

[21] Appl. No.: 808,428

[22] Filed: Dec. 12, 1985

[30] Foreign Application Priority Data

Mar. 30, 1985 [DE] Fed. Rep. of Germany ..... 3511819

[51] Int. Cl.[4] ..... F01L 1/24; F02D 13/00

[52] U.S. Cl. ..... 123/90.16; 123/90.12; 123/198 F

[58] Field of Search ..... 123/198 F, 90.12, 90.16, 123/90.14, 90.11

[56] References Cited

U.S. PATENT DOCUMENTS 2,019,252 10/1935 Cottingham ..... 123/90.16
4,153,016 5/1979 Hausknecht ..... 123/90.16
4,278,233 7/1981 Turner et al. ..... 123/90.16
4,337,739 7/1982 Jordan ..... 123/198 F
4,466,390 8/1984 Babitzka et al. ..... 123/90.12

FOREIGN PATENT DOCUMENTS 3135650 3/1983 Fed. Rep. of Germany .

*Primary Examiner*—Ira S. Lazarus
*Attorney, Agent, or Firm*—Michael J. Striker

[57] ABSTRACT

A valve control arrangement for internal combustion engines with reciprocating pistons, comprises a housing having a housing opening, a valve piston axially displaceable in the housing opening, a valve closing spring, a valve plunger on which the valve piston acts against the valve closing spring, a cam piston axially displaceable in the housing opening, a valve control cam, a pressing spring which presses the cam piston against the valve control cam, a working chamber formed between the valve piston and the cam piston and arranged to be filled with pressure medium which transmits a lifting movement of the cam piston to the valve piston, the pressing spring which acts on the cam piston being arranged outside of the working chamber and supported at the side of the housing.

18 Claims, 4 Drawing Figures

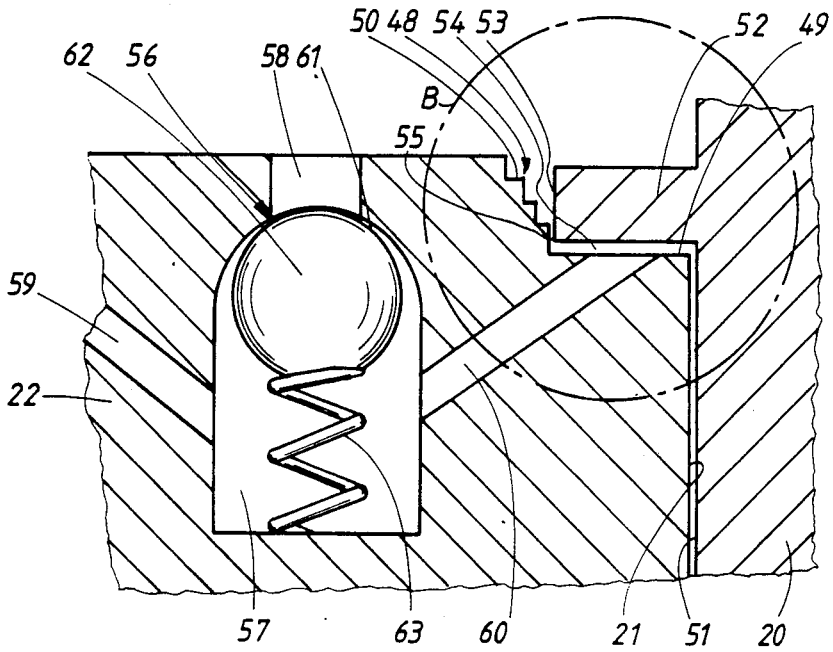
Fig. 2
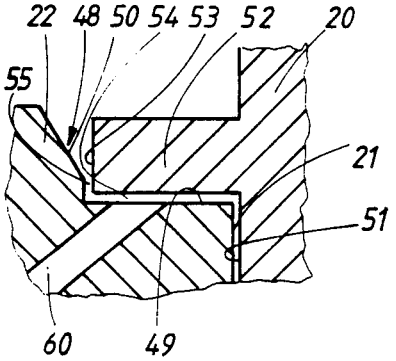
Fig. 3
Fig. 4
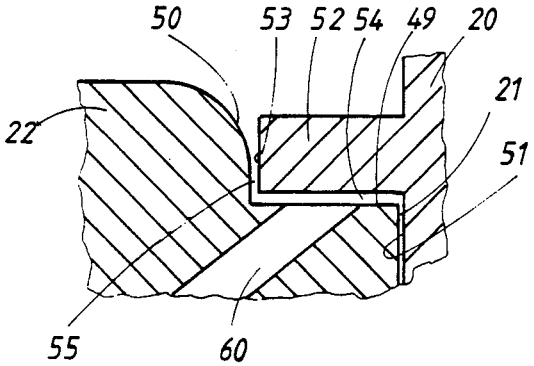

VALVE CONTROL ARRANGEMENT

BACKGROUND OF THE INVENTION

The present invention relates to a valve control arrangement, particularly for internal combustion engines with reciprocating pistons.

Valve control arrangements of the above-mentioned general type are known in the art. One such valve control arrangement is disclosed, for example, in the DE-OS No. 3,135,650. Here a pressing spring which presses the cam piston against the valve control cam is arranged in pressure medium-filled working chamber between the cam piston and the valve piston and is supported on these both pistons. In this arrangement it has been determined that because of relatively high detrimental compression volumes in the working chamber, the rotary speed limit in which a control is still possible or in other words, in which a pressure medium adjustment from the working chamber is possible, is relatively low. With higher rotary speeds, pressure variations take place in the working chamber which lie in their pressure values under the pressure values of the pressure medium. Thereby because of lack of a sufficiently high pressure fall between the supply pressure and the pressure of the working chamber, no control can be achieved.

SUMMARY OF THE INVENTION

Accordingly, it is an object of the present invention to provide a valve control arrangement of the above-mentioned general type which avoids the disadvantages of the prior art.

More particularly, it is an object of the present invention to provide a valve control arrangement which has the advantage that by placing the cam piston pressing spring outside of the working chamber, the detrimental compression volumes cannot be reduced to significant volumes of the pressing spring. Therefore, the rotary speed limit for the control is considerably increased.

These advantages of the present invention are achieved when the pressing spring is located outside of the working chamber and abuts at the side of the housing.

A further reduction of the detrimental compression volume is obtained when a supply conduit portion between the working chamber and the working valve has an extremely small volume.

In accordance with another advantageous feature of the present invention, the cam piston has a piston part which slides in a housing opening and a concentrical cup-shaped or hood-shaped guiding part which is axially displaceable in a guiding chamber coaxial to the housing opening, and the pressing spring is arranged in the guiding chamber. In this construction the structural changes of the cam piston required for the pressing spring are achieved in technically advantageous manner.

In accordance with a further advantageous feature of the present invention the guiding part and the piston part of the cam piston are formed as two separate parts, and the piston part is provided with a ring-shaped flange against which the pressing spring abuts. Since the cam piston is formed of two separate parts, the piston part is articulatedly connected only with the guiding part which abuts against the valve control cam and therefore released from tension so that unnecessary friction in the case of virtual movement of the piston during the working play is avoided.

Still a further feature of the present invention is that the pressing spring is dimensioned so that in all movement conditions of the cam piston, the piston part abuts against the guiding part. Because of this construction of the pressing spring it is guaranteed that the piston part is always in abutment against the guiding part and it always abuts against the valve control cam.

In accordance with a further advantageous embodiment of the invention, a central throttling opening is provided in the cam piston. This small opening or openings with nozzles or constrictions which are in alignment with the piston part and the guiding part, provide for degasing of the pressure medium volume and formation further damaging compression volumes. At the same time, small pressure medium quantities flowing away via the openings provide lubrication between the valve cam and cam piston and thereby reduction of friction losses.

Another embodiment of the invention is that the valve piston is provided at its end side limiting the working chamber with a step which has a ring-shaped radial shoulder and a cylindrical axial flank, and a housing wall has a flange-like ring-shaped projection which limits with the radial shoulder a ring chamber on the one hand, and forms with the axial flank a ring gap extending axially and directly connected with the ring chamber. When the arrangement is designed with these features, during the control process or in other words during releasing of pressure medium from the working chamber and thereby returning valve piston, the increasing overlapping of the projection of the housing wall and the step of the piston provides for stepless and continuously narrowing annular gap which increasingly closes the ring-shaped chamber. Thereby after squeezing the pressure medium available there via the ring-shaped gap, a pressure is formed which provides end position damping of the valve piston and thereby end position damping of freely moveable valve of the internal combustion engine.

The axial flank of the step can extend in a stairlike manner from the ring shaped projection of the housing wall. The axial flank can extend with an axial distance from the ring-shaped radial shoulder under an acute angle to the piston axis toward the piston end side. Finally, the axial flank can extend with an axial distance from the ring-shaped radial shoulder toward the piston end side with convex curvature. Therefore, a desired path-time characteristic can be provided depending on the type of the internal combustion engine.

The valve piston can be provided with a check valve located between a central axial passage opening into the working chamber on the one hand, and passages opening into the ring chamber, on the other hand, with working direction from the ring-shaped chamber toward the working chamber. In this case during a new piston stroke of cam and valve pistons, the ring chamber is supplied without resistance and result in generation of negative pressure with pressure medium which flows via the check valve from the working chamber to the ring chamber.

The arrangement can be provided with a path-measuring device which is connected with the valve piston and arranged in a spring chamber for the valve closing spring. The path measuring device can include a measuring bell connected with the valve plunger and an induction coil arranged concentrically to the measuring bell and accommodated in the spring chamber. The thus obtained monitoring of the movement of the valve of the internal combustion engine can be used for measuring the valve time cross-section and as control value for small regulating circuits. The path measurement is performed inductively.

The working valve can be formed as 2/2-way magnetic valve operating with compression pressure support and advantageously releasing the opening cross-section of the pressure medium supply conduit in its inoperative position. By the compression support during opening of the locking valve, very small switching time is obtained. The formation of the magnetic valve as closer has the advantage that in the event of current failure the magnetic valve opens and because the pressure resolution in the working chamber the inlet valve of the internal combustion engine can no longer open. Thereby no fuel mixture reaches the combustion chamber of the internal combustion engine and flows out of the same. The magnetic force of the magnetic valve is selected so that the magnetic valve can be closed from the working chamber also against high shock pressures during the pressure medium discharge. As a result of this, the working chamber can be closed during the cam lifting cycle and thereby the inlet valve of the internal combustion engine can make only a partial path.

Finally, the check valve can be formed as a low-mass plate valve. In this case a very low-mass check valve is provided whereby the detrimental compression volumes are further reduced.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 2 is a view showing a fragment A of FIG. 1 on an enlarged scale;

FIG. 3 is a view showing the control arrangement in accordance with a further embodiment of the invention; and FIG. 4 is a view showing a fragment B in FIG. 2.

DESCRIPTION OF THE PREFERRED EMBODIMENTS

Figure 1:
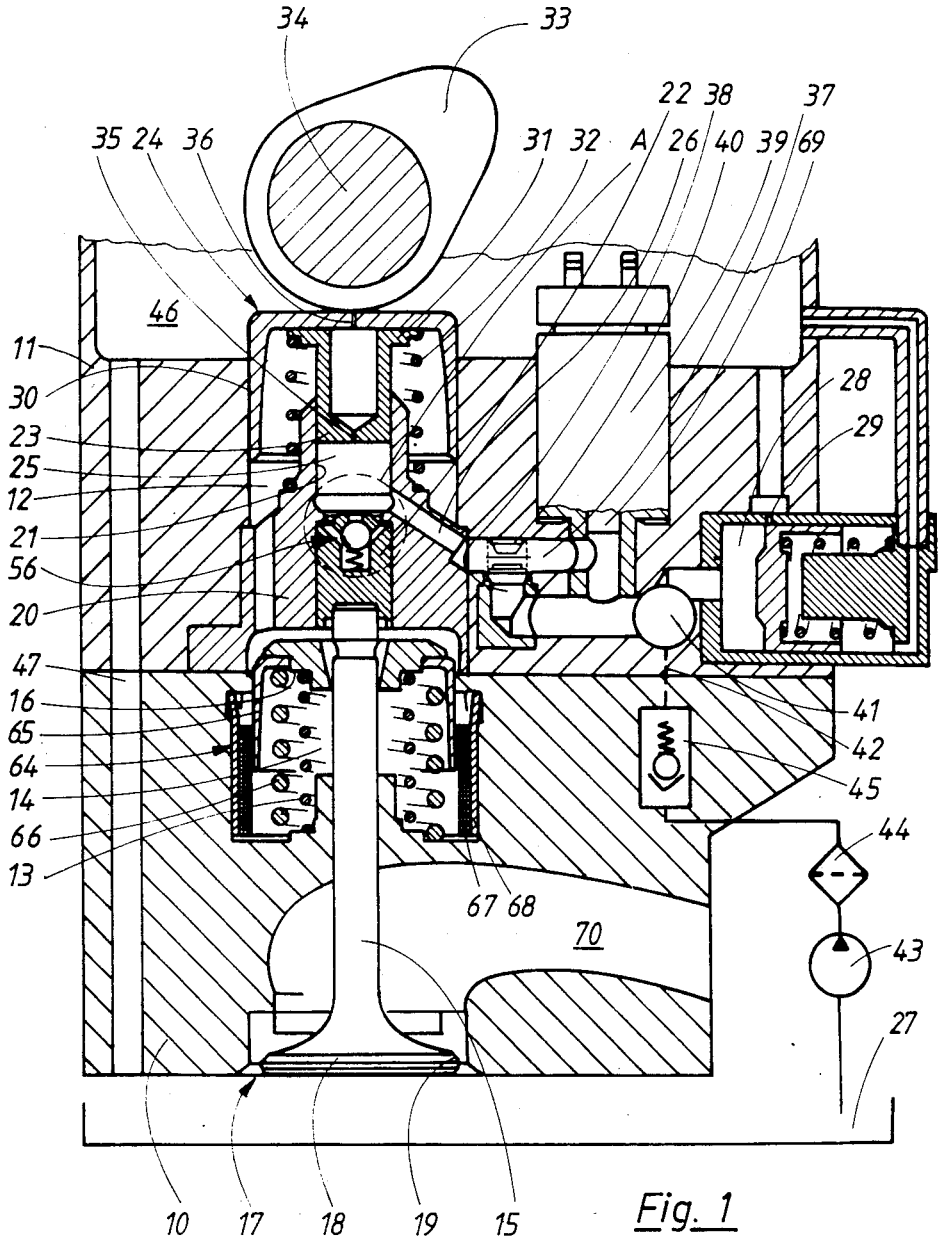
FIG. 1 is a longitudinal section of a valve control arrangement for an inlet valve of an internal combustion engine with reciprocating pistons, shown partially schematically.

FIG. 1 schematically shows a valve control arrangement for an internal combustion engine with reciprocating pistons. It has a housing 11 which is arranged on a valve housing 10 of the internal combustion engine. A housing chamber 12 is provided in the housing 11 so that it is in alignment with a spring chamber 14 which receives two coaxial valve closing springs 13 and 66. The valve closing springs 13 and 66 are supported at their one side against a bottom of the spring chamber 14 and at their other side, against a pressing piece 16 which is fixedly connected with a valve plunger 15. The valve plunger 15 which extends to an inlet valve 17 of the internal combustion engine carries a valve member 18 at its one end. The valve member 18 cooperates with a valve seat 19 which is arranged in the valve housing 10.

A housing block 20 is inserted in the housing chamber 12 from below. The housing block 20 has a central axial throughgoing housing opening 21. A valve piston 22 which is loosely connected with the valve plunger 15, is axially displaceable in the housing opening 21. Also, a piston part 23 of a cam piston 24 is also axially displaceably arranged in the same housing opening 21.

The valve piston 22 and piston part 23 of the cam piston 24 limit a working chamber 25 which can be filled with oil via an oil supply 26 from a supply chamber 27 or from a spring accumulator 28 with an excess-pressure valve 29. The cam piston 24 has two parts and particularly, in addition to the piston part 23, has also a guiding part 30 which concentrically overlaps the piston part 23 and is cup-shaped or hood-shaped. The guiding part 30 is axially displaceable in the housing chamber 12 and performs additionally the function of a guiding chamber.

The piston part 23 abuts with its end side which faces away of the working chamber 25 against a bottom of the cup-shaped guiding part 30 and carries in this region a ring flange 31. A pressing spring 32 which is formed as cylindrical helical spring engages with the ring flange 31. The pressing spring 32 concentrically surrounds the piston part 23 and the working chamber 25 and is supported outside on the housing block 20. The pressing spring 32 presses the piston part 23 against the guiding part 30 of the cam piston 24 and the cam piston 24 against a valve control cam 33 which is rotatably seated on a cam shaft 34. The pressing spring 32 is dimensioned so that the above-described arrangement is reliably guaranteed in all acceleration conditions of the cam piston 24.

Various small openings 35 and 36, or openings with nozzles or restrictors, are provided centrally in the piston part 23 and in the guiding part vicinity of the cam piston 24. Gas inclusions which reach the working chamber 25 in oil and move upwardly in the working chamber 25 to the piston face of the piston part 23 can be withdrawn through these openings. An additional action of the openings is that because of small oil escape a smearing between the valve control cam 33 and the cam piston 24 is provided so that the friction losses of the cam drive can be eliminated.

The oil conduit 26 has two parallel conduit branches 37 and 38. A blocking valve which is formed as 2/2 directional control magnet valve 39 is arranged in the conduit branch 37. A check valve 40 which is formed as a plate valve is arranged in the other conduit branch 38 and has a locking direction away of the working chamber. A third conduit branch 42 opens into a branching point 41 of the oil conduit 26, which lies between the parallel conduit branches 37, 38 and the spring accumulator 28. The conduit branch 42 is supplied with oil from the container 27 via a pump 43 and oil filter 44 and a jack valve 45. The oil conduit 26 is designed with a very small volume particularly in the conduit portion between the working chamber 25 and the magnet valve 39.

The conduit branch 38 with the check valve 40 arranged at its inlet has, to the contrary a relatively great volume and serves as an oil stabilizing chamber. The spring accumulator 28 is formed so that during the operation only relatively small oil quantities flow via the excess-pressure valve 29 into a return container 46 and from there via a return passage 47 into the housing 11 and the valve housing 10 to the supply container 27. With this small oil exchange between the working chamber 25 and the supply container 27, the oil quantity reciprocating between the working chamber 25 and the spring chamber 28 during controlling processes remains substantially constant, so that the oil volume which is degasified via the openings 35, 36 has a better control quality.

A so-called valve brake is provided on the valve piston 22 and acts for end position damping of the valve member 18 which moves back free to its valve seat 19 during the valve closing moment. As can be seen from FIG. 2, which shows a fragment A of the valve piston 22 and the housing block 20 on an enlarged scale, the valve piston 22 is provided for this purpose on its end side which limits the working chamber 25, with a step 48. The step 48 has a ring-shaped radial shoulder 49 which extends inwardly toward a wall 51 of the housing opening 21, and a cylindrical axial flank 50. A flange-like ring-shaped projection 52 extends from the wall 51 of the housing opening 21 and limits together with the radial shoulder 49 a ring-shaped chamber 54. Its radial extension is dimensioned so that between the axial flank of the ring-shaped step 48 and the cylindrical ring-shaped surface 53 of the ring-shaped projection 52, a ring-shaped gap 55 is provided. The ring-shaped gap 55 is connected in an axial direction with the ring-shaped chamber 55 and extends in an axial direction.

The cylindrical axial flank 50 of the step 48 is stair-like, as can be seen from FIG. 2. The distance between the stair-like axial face 50 from the ring-shaped face 53 of the ring-shaped projection 52 increases in direction toward the end side of the valve piston 22. As can be seen from FIGS. 3 and 4, the axial flank 50 can also be inclined or curved, starting from a certain axial distance from the radial shoulder 49 of the step 48. In these both cases the distance between the axial flank 50 and the ring-shaped face 53 of the ring-shaped projection 52 increases progressively in direction toward the end side of the valve piston and thereby the ring-shaped gap 55 as well. During the controlling process, in other words, with the valve piston 22 moving back, the ring-shaped chamber 54 is increasingly closed by the ring-shaped gap 55 which narrows with increasing overlapping of the axial flank 50 of the step 48 and the ring-shaped face 53 of the ring-shaped projection 52. Therefore, after the oil squeezed over the ring-shaped gap 55 obtains higher pressure, an end position damping of the valve piston 22 takes place and thereby via the valve plunger 15 connected with the valve piston an end position damping of the inlet valve 17 of the internal combustion engine takes place. Thereby during new movement cycle with the valve piston 22 moving downwardly as shown in the drawing, the ring-shaped chamber 54 is supplied with oil very well without resistance and without generation of negative pressure. A check valve 56 is integrated in the valve piston 22.

A central or medium axial passage 58 opens into a valve chamber 57 arranged in the vicinity to the end side of the valve piston 22. Several passages 59 and 60 which extend inclined through the valve piston 22 to the ring-shaped chamber 55 also open into the valve chamber 57. The axial passage 58 which opens into the working chamber 25 is provided with a valve seat 61 at its mouth in the valve chamber 57. A ball 62 is pressed against the valve seat 61 by a spring 63. With pressure increase in the working chamber 25, the ball 62 is lifted from the valve seat 61 and oil can flow from the working chamber 25 over the passages 59 and 60 into the ring chamber 54 so that the latter is supplied with oil. In the event of the pressure increase in the ring-shaped chamber 54, the ball 62 seals the valve seat 61 so that no oil can flow from the ring-shaped chamber 54 via the axial passage 58 into the working chamber 25 and the end position damping takes place as described hereinabove.

For the increasing control of the movement of the inlet valve 17, a path measuring device 64 is coupled with the valve piston 22. The path measuring device 64 is arranged in the spring chamber 14 together with the valve closing spring 13. The path measuring device 64 includes a measuring bell 65 of a non-magnetic material, for example aluminum or titanium and is pressed against the pressing piece 16 by a valve closing spring 66 which is coaxial to the valve closing spring 13. This measuring bell 65 moves during movement of the valve plunger 15 into an induction field and thereby changes the latter by the whirl current field produced in it. The change of the induction field is a measure for the covered path distance of the valve plunger 15. The induction field is generated by an induction coil 67 which is arranged in an aluminum pipe 68 accommodated in the spring chamber 14. By the monitoring of the movement of the inlet valve 17, the time section of the valve is exactly measured and is provided as control value for smaller regulating circuits.

The 2/2 directional control magnetic valve 39 arranged in the oil conduit 26 is formed as a closer, or in other words it closes in response to magnetic energizing and opens in response to magnetic turning off. This has the advantage that in the event of current failure the magnetic valve 39 remains open and the opening cross-section of the oil conduit 26 remains free. During the lifting movement of the camp piston 24 the oil can flow from the working chamber 25 so that the lifting movement of the cam piston 24 is not transferred to the valve piston 22. The valve piston 22 assumes its inoperative position shown in FIG. 1 and the inlet valve 17 remains closed despite turning of the cam 33, so that no fuel mixture can be supplied into the combustion chamber of the internal combustion engine and flow from the latter. The magnet valve 39 operates with compression support from the working chamber 25. For this purpose, the valve shaft 69 which forms the valve member is formed stepped so that the pressure from the working chamber 25 acts upon the ring-shaped shoulder of the stepped valve shaft 69 amd accelerates the same during switching off of the magnet energizing in direction toward opening. The magnet of the magnetic valve 39 is formed so that the magnetic valve 39 can also be closed from high shock pressure during flowing out process from the working chamber. As a result of this, the working chamber 25 can be closed also during the cam lifting cycle.

The operation of the above-described valve adjusting arrangement is known and disclosed in detail for example in the DE-OS No. 3,135,650. It should be mentioned in connection with this that during rotation of the cam 33 the cam piston 24 is downwardly in FIG. 1. During this phase the magnet valve 39 is energized and the oil-filled working chamber 25 is hermetically closed. The lifting movement of the cam piston 24 is transmitted via the oil cushion in the working chamber 25 to the valve piston 24 which is thereby also displaced and lifts, via the valve plunger 15, the valve member 18 of the inlet valve 17 from the valve seat 19. The fuel mixture can now flow via an inlet 70 into a not shown combustion chamber of the internal combustion engine. In correspondence with the desired time cross-section of the inlet valve 17, it is possible in any time point, also during the lifting movement of the cam piston 24 in FIG. 1 downwardly, to perform the closing process of the inlet valve 17 by switching-off of the magnet valve 39. With switching-off of the exciting current, the magnet valve 39 opens, and under the action of the valve closing spring 13 the valve piston 22 can move upwardly with displacement of oil from the working chamber 25 via the opened magnet valve 39 into the spring chamber 28. Shortly before the valve piston 22 reaches its end position on the ring-shaped projection 52, the above-described end position damping takes place so that the valve member 18 is damped and seated on the valve seat 19 in a shock-free manner. If after the respective rotation of the valve control cam 33 the cam piston 24 is again moved to its basic position shown in FIG. 1, the oil flows from the spring accumulator 28 via the opened magnet valve 39 or the closed magnet valve 39 via the check valve 40 into the working chamber 25. Oil losses are compensated from the supply container 27 via the pump 43 and the check valve 45.

It will be understood that each of the elements described above, or two or more together, may also find a useful application in other types of constructions differing from the types described above.

While the invention has been illustrated and described as embodied in a valve control arrangement for reciprocating piston-internal combustion engines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A valve control arrangement for internal combustion engines with reciprocating pistons, comprising a housing having a housing opening; a valve piston axially displaceable in said housing opening; a valve closing spring; a valve plunger on which said valve piston acts against said valve closing spring; a cam piston axially displaceable in said housing opening; a valve control cam; a pressing spring which presses said cam piston against said valve control cam; a working chamber formed between said valve piston and said cam piston and arranged to be filled with pressure medium which transmits a lifting movement of said cam piston to said valve piston, said pressing spring which acts on said cam piston being arranged outside of said working chamber and supported at the side of said housing.

2. A valve control arrangement as defined in claim 1, wherein said cam piston has a piston part which slides in said housing opening and a guiding part which engages said piston part and is concentrical relative to the latter, said housing having a guiding chamber which is coaxial to said housing opening, said guiding part being axially displaceable in said guiding chamber, and said pressing spring being arranged in said guiding chamber.

3. A valve control arrangement as defined in claim 2 wherein said guiding part of said cam piston is cup-shaped.

4. A valve control arrangement as defined in claim 2, wherein said guiding part of said cam piston is hood-shaped.

5. A valve control arrangement as defined in claim 2, wherein said guiding part and said piston part of said cam piston are separate parts, said piston part having an end side which faces toward said guiding part and being provided at said end side with a ring-shaped flange against which said pressing spring engages.

6. A valve control arrangement as defined in claim 2, wherein said pressing spring is dimensioned so that in all movement conditions of said cam piston said piston part of said cam piston abuts against said guiding part of the same.

7. A valve control arrangement as defined in claim 1; and further comprising means forming a pressure medium conduit leading toward said working chamber and provided with a locking valve, said pressure medium conduit in the region between said working chamber and said working valve is formed so that it has a minimal volume.

8. A valve control arrangement as defined in claim 1, wherein said cam piston has a central throttling opening extending through said cam piston.

9. A valve control arrangement as defined in claim 1, wherein said valve piston has an end side which limits said working chamber and is provided at said end side with a step which forms a ring-shaped radial shoulder extending toward said houing opening and with a cylindrical axial flank, said housing having a wall which limits said housing opening, and is provided with a flange-like ring-shaped projection, said ring-shaped projection limits together with said radial shoulder a ring-shaped chamber, said ring-shaped projection also forms with said axial flank a ring-shaped gap which extends axially directly into said ring chamber.

10. A valve control arrangement as defined in claim 9, wherein said axial flank of said step extends inwardly from said ring-shaped projection of said housing wall in a stairs-like manner.

11. A valve control arrangement as defined in claim 9, wherein said valve piston has a piston axis and a piston end side, said axial flank extending with an axial distance from said ring-shaped radial shoulder under an acute angle relative to said piston axis towards said piston end side.

12. A valve control arrangement as defined in claim 9, wherein said valve piston has a piston end side, said axial flank extending with an axial distance from said ring-shaped radial shoulder of said step relative to said piston end side and is convexly curved.

13. A valve control arrangement as defined in claim 9; and further comprising means forming a central axial passage which opens into said working chamber and further passages which open into said ring-shaped chamber, said valve piston having a check valve which is integrated in said valve piston and arranged between said central axial passage and said further passages, said check valve having a locking direction from said ring chamber toward said working chamber.

14. A valve control arrangement as defined in claim 1; and further comprising means forming a spring chamber for receiving said valve closing spring; and path measuring device coupled with said valve piston and arranged in said spring chamber.

15. A valve control arrangement as defined in claim 14, wherein said path measuring device has a measuring bell which is connected with said valve plunger, and an induction coil arranged concentrically to said measuring bell in said spring chamber.

16. A valve control arrangement as defined in claim 7, wherein said locking valve is formed as a 2/2 directional control magnetic valve operating with compression pressure support.

17. A valve control arrangement as defined in claim 16, wherein said locking valve is formed so that in its inoperative position it releases an opening cross-section of said pressure medium supply conduit.

18. A valve control arrangement as defined in claim 7; and further comprising means forming a bypass which bridges said locking valve; and a check valve associated with said bypass and having a locking direction away of said working chamber, said check valve being formed as low-mass plate valve.

* * * * *